US006857881B1

(12) United States Patent
Balfour

(10) Patent No.: US 6,857,881 B1
(45) Date of Patent: Feb. 22, 2005

(54) METER BOX GROUND CLAMP

(75) Inventor: William J. Balfour, Winsted, CT (US)

(73) Assignee: Electric Motion Company, Inc., Winsted, CT (US)

( * ) Notice: Subject to any disclaimer, the term of this patent is extended or adjusted under 35 U.S.C. 154(b) by 0 days.

(21) Appl. No.: 10/843,981

(22) Filed: May 12, 2004

(51) Int. Cl.[7] ..... H01R 4/66
(52) U.S. Cl. ..... 439/92; 439/803
(58) Field of Search ..... 439/92, 803

(56) References Cited

U.S. PATENT DOCUMENTS

| | | | | | |
|---|---|---|---|---|---|
| 4,784,621 | A | | 11/1988 | Auclair | 439/793 |
| 4,828,504 | A | * | 5/1989 | Franks, Jr. | 439/92 |
| 4,904,193 | A | * | 2/1990 | Graves | 439/92 |
| 5,746,609 | A | | 5/1998 | Franks, Jr. | 439/92 |
| 5,928,006 | A | | 7/1999 | Franks, Jr. | 439/92 |
| 6,329,592 | B1 | | 12/2001 | Auclair | 174/51 |

* cited by examiner

*Primary Examiner*—Tho D. Ta
(74) *Attorney, Agent, or Firm*—Alix, Yale & Ristas, LLP

(57) ABSTRACT

A meter box ground clamp for clamping a ground wire to a metallic meter box includes a clamp body, a pressure bar, a floating nut, a bolt member and a ground engagement bolt. The clamp body has a base segment and first and second leg segments, each of the leg segments having a laterally extending extension segment for engaging the exterior surface of the meter box drip cap. The pressure bar extends through a slot in the clamp body base segment and has a front segment, disposed below the clamp body extension segments, having a laterally extending groove forming a lip at the pressure bar front end. The floating nut extends through the clamp body base segment slot and includes a front portion having a threaded, vertically extending bore. The bolt member is threadably engaged with the bore of the floating nut front portion for driving the lip of the pressure bar front segment into the meter box overlap joint to electrically connect the ground clamp to the meter box. The threaded shaft of the ground engagement bolt is received within a threaded opening of the pressure bar back segment to clamp a ground wire positioned within a bore of the pressure bar segment.

23 Claims, 5 Drawing Sheets

METER BOX GROUND CLAMP

BACKGROUND OF THE INVENTION

This invention relates generally to devices for implementing a ground connection between an electrical meter box and a common ground point. More particularly, the present invention relates generally to clamp devices which mount to an electrical meter box and connect via a flexible conductor with a common ground point.

A number of various types of devices have been employed for connecting a ground wire with an electrical meter box. Most conventional devices employ clamp assemblies of various forms. In applications to which the present invention relates, the connecting devices are ordinarily clamped onto the exterior of the electrical meter box which is mounted on the wall of a building.

A number of conventional designs are configured to mount rigidly or semi-rigidly onto the electrical meter box. For such designs, damage to the electrical meter box can occur when the clamping force is applied to the electrical meter box. For example, it is not uncommon for the electrical meter box to be bent or twisted when the clamping force is applied.

In another known design, the device clamps onto a corner of the electrical meter box. A lower flange of the device engages a bottom skirt of the electrical meter box top cover. A bolt threadably disposed through a top plate of the device engages the electrical meter box top cover. Applying a torque to the bolt causes the device to be clamped to the electrical meter box. Such devices may not provide an adequate electrical connection with the electrical meter box.

A ground clamp disclosed in U.S. 6,329,592 includes a U-shaped clamp member having first and second legs which form a slot. A pair of openings in the first leg form a center segment disposed between two fingers. The edge portion of the meter box enclosure is resiliently clamped within the slot between the fingers and the second leg. The center segment includes a threaded socket. A bolt member has a stud portion and a bolt head portion, the stud portion including a threaded segment disposed proximate the distal end and an unthreaded shaft segment disposed intermediate the threaded segment and the bolt head portion. At least one protrusion extends axially from the distal end of the bolt member to a sharp edge. The stud portion is mounted in the socket of the clamp member such that the shaft segment is positioned in the threaded portion of the socket and the threaded segment is positioned within the slot when the sharp edge of the protrusion contacts the exterior surface of the edge portion received within the slot. The sharp edge of the protrusion removes the corrosion inhibiting coating from the exterior surface of the edge portion to electrically connect the meter box to the clamp without deforming the meter box enclosure upon rotation of the bolt member. However, a hammer or similar tool is usually required to insert the second leg of the clamp member between the bottom skirt of the meter box top cover and the side or front panel of the meter box.

SUMMARY OF THE INVENTION

Briefly stated, the invention in a preferred form is a meter box ground clamp for clamping a ground wire to a metallic meter box. The meter box ground clamp comprises a U-shaped clamp body including first and second leg segments and a base segment forming a vertically extending, open channel. Each of the leg segments has a laterally extending upper extension segment. The base segment has a middle portion defining a longitudinally extending slot, a lower portion extending obliquely from the middle portion into the channel, the lower portion defining a substantially circular opening, and an upper portion extending longitudinally from the middle portion. A pressure bar extends from a front end to a rear end through the slot of the clamp body middle portion. The pressure bar includes a front segment extending from the clamp body slot to the pressure bar front end and a rear segment extending from the clamp body slot to the pressure bar rear end. The front segment is at least partially disposed within the clamp body channel and has an upper surface defining a laterally extending groove forming a lip at the pressure bar front end. The rear segment defining a vertically extending bore and a threaded opening, extending from a side of the rear segment and intersecting the bore. A floating nut extending from a front end to a rear end through the slot of the clamp body middle portion. The floating nut is disposed below the pressure bar and includes a front portion extending from the clamp body slot to the floating nut front end and a rear portion extending from the clamp body slot to the floating nut rear end. The front portion is at least partially disposed within the clamp body channel and defines a vertically extending bore having a threaded surface. A bolt member includes a bolt head disposed below the lower portion of the clamp body base segment, and a shaft extending upwardly from the bolt head through the opening of the lower portion of the clamp body base segment to a distal end contacting the pressure bar front segment. At least a portion of the shaft has a threaded surface threadably engaged with the bore of the floating nut front segment A ground engagement bolt includes a bolt head, and a threaded shaft extending from the bolt head. The threaded shaft is received within the threaded opening of the pressure bar rear segment and is threadably displaceable therein to clamp a ground wire positioned within the bore of the pressure bar segment. The extension segments of the clamp body legs are adapted for engaging the exterior surface of the drip cap and the bolt member is adapted for threadably driving the lip of the pressure bar front segment into the meter box overlap joint whereby the lip of the pressure bar front segment mechanically engages the abutting surfaces of the edge portion of the meter box drip cap and the upper end portion of the meter box panel to electrically connect the ground clamp to the meter box.

The leg segments of the clamp body have a lower portion extending obliquely into the clamp body channel below the lower portion of the base segment.

The slot of the clamp body middle portion includes a main portion and a lower end portion. The pressure bar and floating nut each also include oppositely disposed first and second sides defining oppositely disposed notches separated by a web of material. The pressure bar notches divide the pressure bar into the front and rear segments and the floating nut notches divide the floating nut into the front and rear portions. The pressure bar web of material and the floating nut web of material are disposed within the slot of the clamp body middle portion. The main portion of the slot of the clamp body middle portion has a width ($W_m$), the lower end portion of the slot of the clamp body middle portion has a width ($W_L$), the pressure bar has a width ($W_{PB}$), the pressure bar web of material has a width ($W_{PBW}$), the floating nut has a width ($W_{FN}$), and the floating nut web of material has a width ($W_{FNW}$), wherein $W_m>W_L$, $W_{PB}>W_m>W_{PBW}>W_L$, and $W_{FN}>W_m>W_L>W_{FNW}$.

The distal end of the bolt member has the shape of a cone having a rounded tip. The lower surface of the pressure bar front segment has a hemispherically-shaped socket for receiving the distal end of the bolt member shaft.

The extension segment of each clamp body leg segment includes a front portion having a downwardly extending tooth, the tooth is adapted for penetrating the corrosion inhibiting coating on the meter box drip cap.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
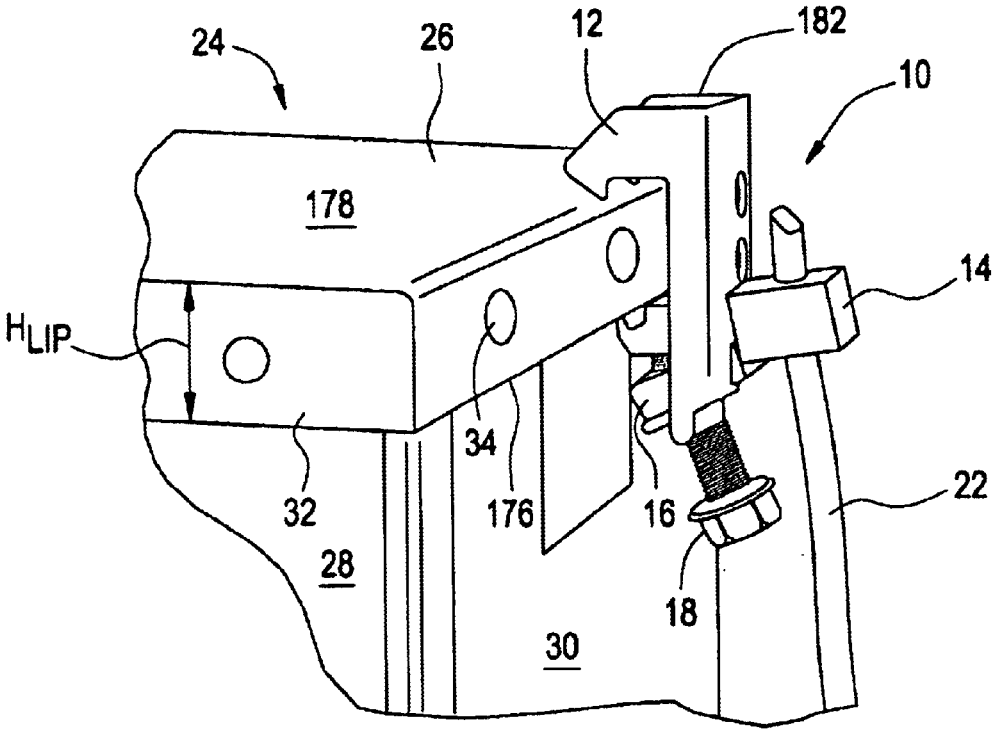
FIG. 1 is a perspective view of a meter box ground clamp in accordance with the invention which is installed on a meter box.
Figure 2:
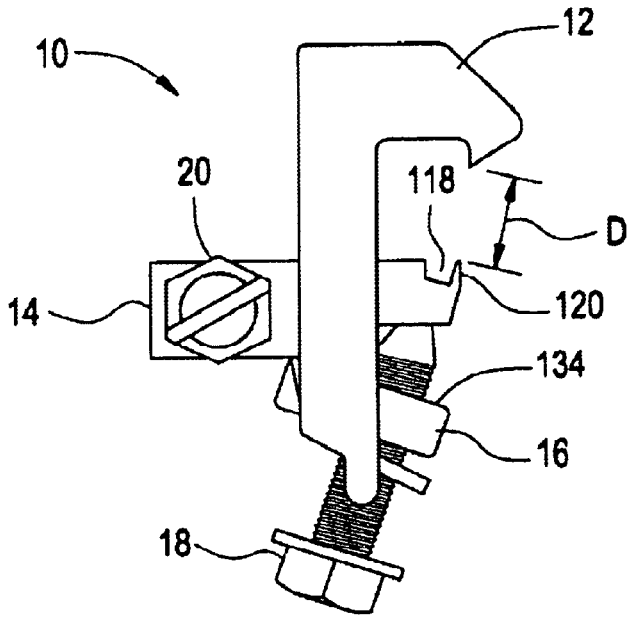
FIG. 2 is an enlarged side view of the meter box ground clamp of FIG. 1.
Figure 3:
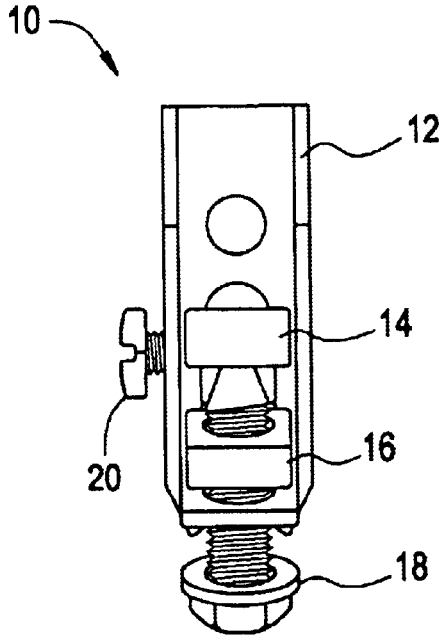
FIG. 3 is an enlarged front view of the meter box ground clamp of FIG. 1.

With reference to the drawings wherein like numerals represent like parts throughout the several figures, a meter box ground clamp in accordance with the present invention is generally designated by the numeral 10. As shown in FIGS. 1, 2 and 3, the ground clamp 10 comprises a clamp body 12, a pressure bar 14, a floating nut 16, a bolt member 18, and a ground engagement bolt 20 which facilitate connecting a ground wire 22 to an enclosure 24 of an electrical meter box. The ground clamp 10 is especially useful for mounting a ground wire 22 to a conventional, rectangular meter box enclosure 24 having a drip cap 26, and front 28, rear (not shown), and side panels 30. Typically, the drip cap 26 of such meter box enclosure 24 has a vertically extending lip portion 32 which overhangs and overlaps the top portions of the front, back and side panels. Generally, lip portion 32 is mounted to the top portions of front, back and side panels by multiple spot welds 34. Although lip portion 32 provides a superior location for mounting the ground clamp 10, it may be mounted to any portion of the meter box enclosure. To facilitate discussion, the ground clamp 10 will be describe in a vertical orientation, as shown in FIGS. 1–3.

Figure 6:
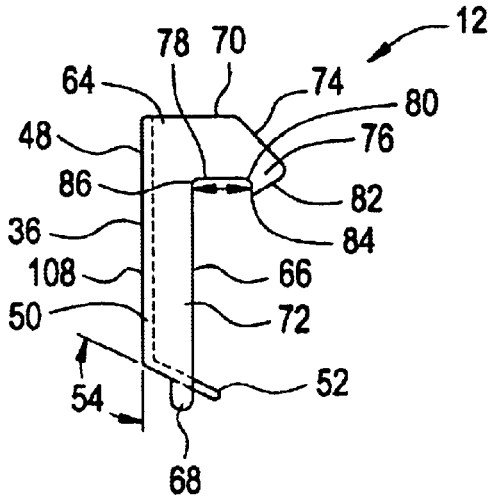
FIG. 6 is an enlarged side view of the clamp body of FIG. 1.
Figure 7:
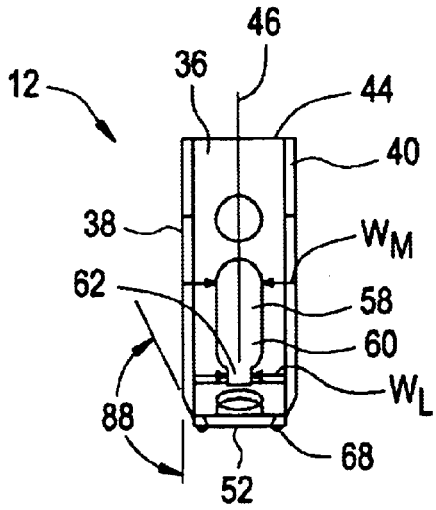
FIG. 7 is a front view of the clamp body of FIG. 6.
Figure 8:
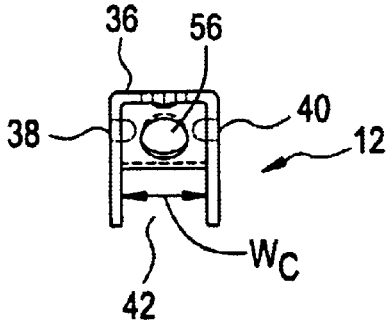
FIG. 8 is a top view of the clamp body of FIG. 6.

With reference to FIGS. 6, 7 and 8, the clamp body 12 is substantially U-shaped, having a base segment 36 and first and second leg: segments 38, 40 forming a longitudinally extending, open channel 42. One of the leg segments 38, 40 extends laterally, preferably perpendicularly, from each side 44 of the base segment 36. The clamp body 12 is preferably composed of stainless steel to provide corrosion resistance and superior strength.

The base segment 36 has a longitudinal axis 46 and upper, middle and lower portions 48, 50, 52. The lower portion 52 of the base segment 36 extends obliquely from middle portion 50 into channel 42, between the first and second leg segments 38, 40. Preferably, lower portion 52 and middle portion 50 form an angle 54 substantially equal to 120°. The lower portion 52 has a generally circular opening 56, preferably disposed axially therein. The middle portion 50 has a longitudinally extending slot 58, preferably disposed axially therein. Slot 58 may include a main portion 60 and a lower end portion 62 extending longitudinally to the lower portion 52 of the base segment 36, where the width $W_M$ of the main portion 60 is greater than the width $W_L$ of the lower end portion 62.

Each leg segment 38, 40 has upper, middle and lower portions 64, 66, 68. The upper portion 64 includes an extension segment 70 that extends laterally from the front edge 72 of the middle portion 66. The front portion 74 of the extension segment 70 has a tooth or prong 76 that extends downwardly from the lower edge 78, the rear edge 80 of the prong 76 and the front edge 72 of middle portion 66 define a gap 86. Preferably, the rear edge 80 of the prong 76 is substantially perpendicular to lower edge 78 and the front edge 82 extends at an acute angle from the rear edge 80, forming a sharp point 84. The lower portion 68 extends obliquely from middle portion 66 into channel 42, below the lower portion 52 of the base segment 36. Preferably, lower portion 68 and middle portion 66 form an angle 88 substantially equal to 152°.

Figure 10:
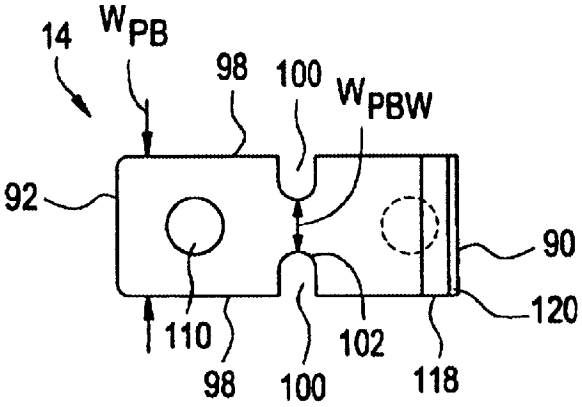
FIG. 10 is a top view of the pressure bar of FIG. 9.
Figure 9:
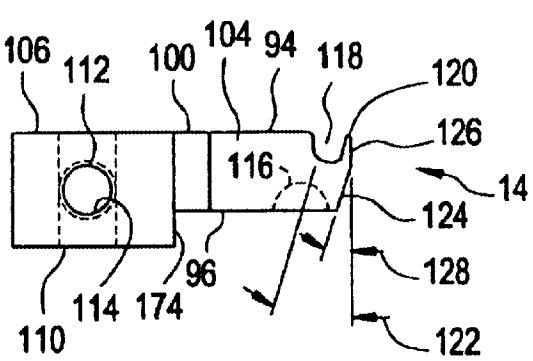
FIG. 9 is an enlarged side view of the pressure bar of FIG. 1.

With reference to FIGS. 9 and 10, the pressure bar 14 has a front end 90, a rear end 92, upper and lower surfaces 94, 96, and oppositely disposed sides 98. The sides 98 define a pressure bar width $W_{PB}$ and have oppositely disposed notches 100 separated by a web 102 of material having a width $W_{PBW}$. The notches 100 are disposed intermediate the front and rear ends 90, 92, dividing the pressure bar into front and rear segments 104, 106. The pressure bar 14 extends through the clamp body slot 58, with the front segment 104 extending laterally into channel 42, the portions of the base segment 36 disposed between the first and second leg segments 38, 40 and slot 58 being received within the pressure bar notches 100, and the rear segment 106 extending laterally from the base segment rear surface 108 (FIG. 6). The pressure bar width $W_{PB}$ is greater than the clamp body slot width $W_m$, preventing the pressure bar 14 from being removed from clamp body slot 58. The width $W_C$ of the channel 42 is sufficiently greater than the pressure bar width $W_{PB}$ and the clamp body slot width $W_m$ is sufficiently greater than the pressure bar web width $W_{PBW}$ to allow the pressure bar 14 to freely move up and down with the clamp body slot 58.

Preferably, the height of the rear segment 106 is greater than the height of the front segment 104. The rear segment 106 has a generally circular bore 110, preferably disposed axially therein, extending from the upper surface 94 to the lower surface 96. An opening 112 in the rear segment 106, which is internally threaded 114, intersects bore 110. Opening 112 may extend from either of the sides 98 or the rear end 92. A socket or hollow 116, preferably having a semi-spherical shape, extends upward from the lower surface 96 of the front segment 104. A groove 118 extends from side 98 to side 98 across the upper surface 94 of the front segment 104, forming a lip 120 at the front end 90. Preferably, the rear edge of the groove 118 and the front end 90 form an angle 122 substantially equal to 15°, providing a wedge shape, and the tip of the lip 120 has a thickness of 0.010 inches, providing a relatively sharp tip. The lower portion of 124 the front end 90 may extend rearwardly from the upper portion 126 of the front end 90, forming an angle 128 substantially equal to 15°.

Figure 13:
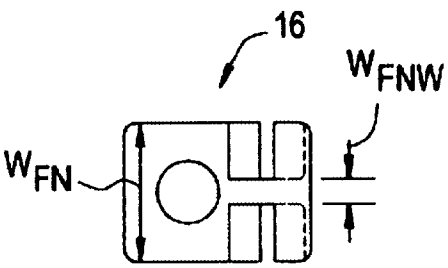
FIG. 13 is a bottom view of the floating nut of FIG. 11.
Figure 12:
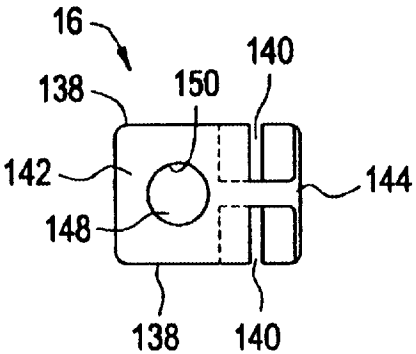
FIG. 12 is a top view of the floating nut of FIG. 11.
Figure 11:
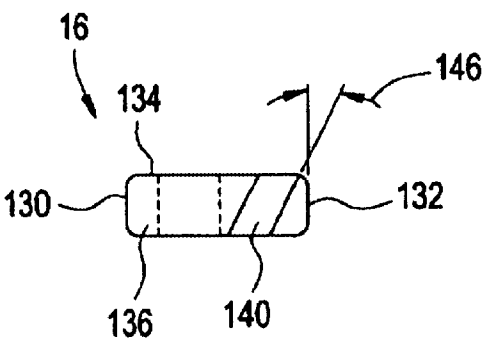
FIG. 11 is an enlarged side view of the floating nut of FIG. 1.

With reference to FIGS. 11, 12 and 13, the floating nut 16 has a front end 130, a rear end 132, upper and lower surfaces 134, 136, and oppositely disposed sides 138. The sides 138 define a floating nut width $W_{FN}$ and have oppositely disposed notches 140 separated by a relatively thin web of material having a width $W_{FNW}$. The floating nut 16 extends through the clamp body slot 58, with a front portion 142 extending laterally into channel 42, the portions of the base segment 36 disposed between the first and second leg segments 38, 40 and slot 58 being received within the floating nut notches 140, and a rear portion 144 extending laterally from the base segment rear surface 108. The floating nut width $W_{FN}$ is greater than the clamp body slot width $W_m$, preventing the floating nut from being removed from clamp body slot 58. The width $W_c$ of the channel 42 is sufficiently greater than the floating nut width $W_{FN}$ and the clamp body slot width $W_m$ is sufficiently greater than the floating nut web width $W_{FNW}$ to allow the floating nut 16 to freely move up and down with the clamp body slot 58. If slot 58 includes lower end portion 62, the width $W_L$ of the lower end portion 62 is also sufficiently greater than the floating nut web width $W_{FNW}$ to allow the floating nut 16 to freely move up and down within both main and lower portions 60, 62 of the clamp body slot 58.

Each of notches 140 extends from a position proximate to the rear end 132 at the upper surface 134 to a position disposed intermediate the front and rear ends 130, 132 at the lower surface 136, the notches 140 preferably forming an angle 146 substantially equal to 27° with the rear end 132. The front portion 142 has a generally circular bore 148, which is internally threaded 150 and preferably disposed axially therein, extending from the upper surface 134 to the lower surface 136. The pressure bar 14 and floating nut 16 are preferably composed of zinc.

Figure 4:
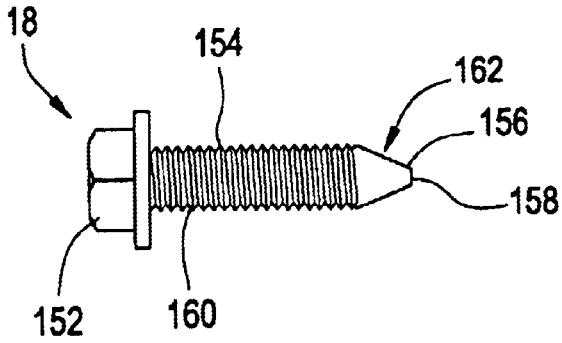
FIG. 4 is an enlarged side view of the bolt member of FIG. 1.

With reference to FIG. 4, the bolt member 18 is composed of silicon bronze, to provide corrosion resistance, high conductivity, and great strength, and has a proximal end in the form of a bolt head 152, a shaft 154 and a distal end 156 having the shape of a cone having a rounded tip 158.

The shaft 154 extends through the base segment lower portion opening 56 and threadably engages the floating nut bore 148, the shaft thread 160 being consistent with the floating nut bore thread 150. The major diameter of the thread 160 is sufficiently smaller than the inside diameter of the base segment lower portion opening 56 to allow bolt member 18 to be cocked relative to the base segment lower portion 52. The tip 158 of the distal end 156 is received within the pressure bar socket 116, bearing on the socket surface. For a –28 bolt member 18, the overall length of the shaft 154 and distal end 156 is 1.00 inches, the sides of the distal end 156 form an angle 162 substantially equal to 45°, and the tip 158 of the distal end 156 is rounded to have a diameter of 0.060 inches.

Figure 5:
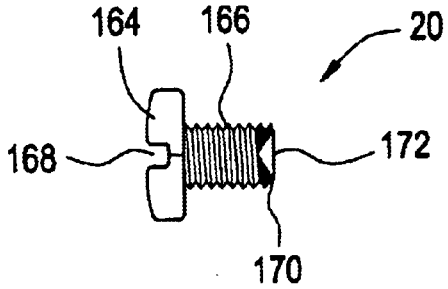
FIG. 5 is an enlarged side view of the ground engagement bolt of FIG. 1.

With reference to FIG. 5, the ground engagement bolt 20 has a head 164 and a threaded shaft 166. The head 164 may have a slot 168, as shown in FIG. 5, a socket, or other device known in the art for receiving a driver such as the blade of a screw driver. The threaded shaft 166 is received within the threaded opening 112 of the pressure bar 14 and is threadably displaceable therein to clamp a ground wire 22 positioned in the bore 110 of the pressure bar 14. The distal end 170 of the ground engagement bolt 20 has a circumferential, axially extending knife-like ridge 172 which digs into the ground wire 22 when the ground engagement bolt 20 is torqued, preventing pull-out of the ground wire 22. The ground engagement bolt 20 is composed of brass to provide corrosion resistance and super electrical conductivity.

With reference to FIG. 1, the ground clamp 10 is preferably installed by first ensuring that the distance D between the point 84 of the clamp body prongs 76 and the pressure bar lip 120 is maximized ($D_{MAX}$). That is, the bolt member 18 is rotated in a counter-clockwise direction until the distal end tip 158 is positioned as closely as possible to the floating nut upper surface 134 while maintaining threaded engagement between the bolt member shaft 154 and the floating nut threaded bore 148. Due to the difference in the heights of the front and rear segments 104, 106 of the pressure bar 14 and due to the angle 146 of the floating nut notches 140, the wedge-shaped rear portion 144 of the floating nut 16 will be disposed between the base segment rear surface 108 and the front surface 174 (FIG. 9) of the pressure bar rear segment 106 when $D=D_{MAX}$, cocking the pressure bar 14 relative to the clamp body 12.

The next step for installing the ground clamp 10 is dependent on the height $H_{LIP}$ of the lip portion. 32 that is the distance between the lower edge 176 (FIG. 1) of the drip cap lip portion 32 and the drip cap upper surface 178. For most commercially available meter boxes, the drip cap lip portion height $H_{LIP}$ is substantially equal to $D_{MAX}$. If $H_{LIP}$ is at the upper tolerance and/or $D_{MAX}$ is at the lower tolerance, the ground clamp 10 is positioned between two of the spot welds 34 mounting the drip cap lip portion 32 to one of the side panels 30 and the lower edge 176 of the drip cap lip portion 32 is inserted into the pressure bar groove 118, the wedge-shaped pressure bar lip 120 being inserted into the seam between the drip cap lip portion 32 and the side panel 30. This provides sufficient clearance between the point 84 of the clamp body prongs 76 and the drip cap upper surface 178 to allow the clamp body prongs 76 to be positioned over the drip cap upper surface 178. Bolt member 18 is then rotated in a clockwise direction, the distal end tip 158 engaging the pressure bar socket surface 116 and pushing the pressure bar 14 into firm engagement with the lower edge 176 of the drip cap lip portion 32, the floating nut lower surface 136 engaging the lower portion 52 of the clamp body base segment 36 and drawing the points 84 of the clamp body prongs 76 into engagement with the drip cap upper surface 178. Additional torque is applied to bolt member 18, causing the points 84 of the clamp body prongs 76 to penetrate the paint coating the drip cap upper surface 178 to provide a metal-to-metal contact between the meter box enclosure 24 and the ground clamp 10.

If $H_{LIP}$ is at the lower tolerance and/or $D_{MAX}$ is at the upper tolerance, the ground clamp 10 is positioned between two of the spot welds 34 mounting the drip cap lip portion 32 to one of the side panels 30 with the clamp body prongs 76 engaging the drip cap upper surface 178 and the pressure bar lip 120 contacting the side panel outer surface. Bolt member 18 is then rotated in a clockwise direction, the distal end tip 158 engaging the pressure bar socket surface 116 and pushing the pressure bar 14 upwards until the pressure bar lip 120 is inserted into the seam between the drip cap lip portion 32 and the side panel 30 and the lower edge 176 of the drip cap lip portion 32 is inserted into the pressure bar groove 118. Additional torque is applied to bolt member 18, causing the points 84 of the clamp body prongs 76 to penetrate the paint coating the drip cap upper surface 178 to provide a metal-to-metal contact between the meter box enclosure 24 and the ground clamp 10.

After the ground clamp 10 is mounted to the meter box enclosure 24, a ground wire 22 is inserted into the pressure bar bore 110 and the ground engagement bolt 20 is torqued to clamp the ground wire 22 therein. A gel-filled boot 180 may be inserted over the upper portion 182 (FIG. 1) of the clamp body 12 to provide a weather-tight seal which prevents the meter box enclosure 24 from corroding in the area from which the paint has been removed.

Figure 14:
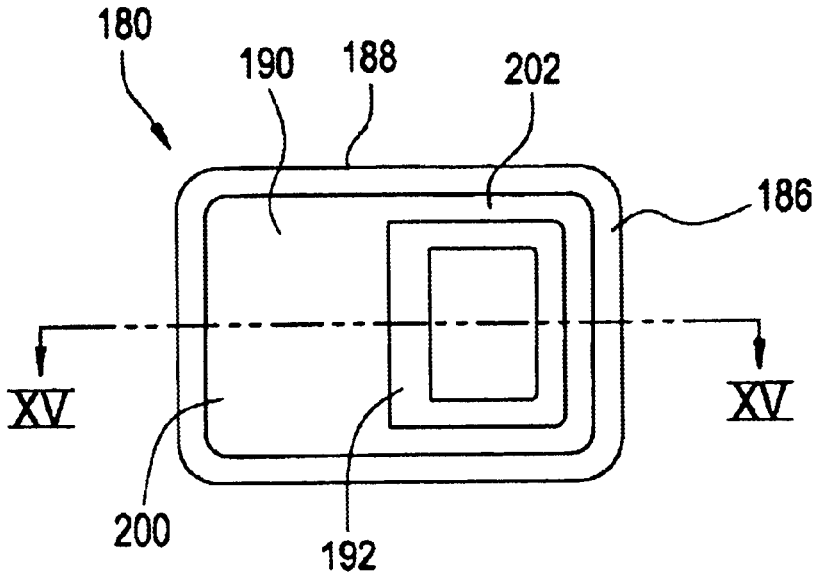
FIG. 14 is a bottom view of a boot for the meter box ground clamp of FIG. 1.
Figure 15:
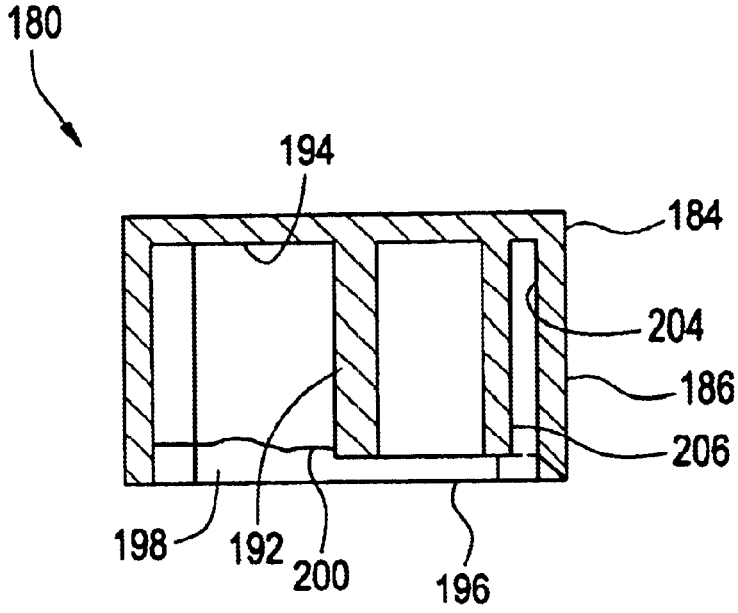
FIG. 15 is a cross-section view of the boot of FIG. 14 taken along line XV—XV.

With reference to FIGS. 14 and 15, boot 180 has a rectangular upper wall 184 and an outer skirt 186 extending downwardly from the outer perimeter 188 of the upper wall 184, the upper wall 184 and outer skirt 186 forming an outer cavity 190. An inner skirt 192 extends downwardly from the lower surface 194 of the upper wall 184 within a first end portion 196 of the outer cavity 190. Preferably, the second end portion 198 of the outer cavity 190 contains a gel 200 for forming a water-tight and air-tight seal at the drip cap upper surface 178. For example, the outer cavity second end portion 198 may be filled with Sealrite SRG-TS™. The boot 180 is installed by inserting the inner skirt 192 into channel 42, with the upper portion 182 of the clamp body 12 being received in the space 202 between the outer and inner skirts 186, 192 and the front portion 74 of the extension segment 70 of the clamp body leg segments 38, 40 being received in the second end portion 198 of the outer cavity 190. The upper portion 182 of the clamp body 12 frictionally engages the inner surface 204 of the outer skirt 186 and the outer surface 206 of the inner skirt 192 to prevent inadvertent removal or loss of the boot 180.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A meter box ground clamp for clamping a ground wire to a metallic meter box, the meter box including a drip cap, a front panel, a rear panel, and left and right side panels, the drip cap having an edge portion forming an overlap joint with an upper end portion of at least one of the panels, the drip cap edge portion and the panel upper end portion having substantially abutting bare-metal surfaces, the meter box having an exterior surface covered by a corrosion inhibiting coating, the meter box ground clamp comprising:

a U-shaped clamp body defining a vertical axis and including first and second leg segments, each of the leg segments having a laterally extending upper extension segment, and a base segment forming a vertically extending, open channel with the leg segments, the base segment having a middle portion defining a longitudinally extending slot, a lower portion extending obliquely from the middle portion into the channel, the lower portion defining a substantially circular opening, and an upper portion extending longitudinally from the middle portion;

a pressure bar extending from a front end to a rear end through the slot of the clamp body middle portion, the pressure bar including a front segment extending from the slot of the clamp body middle portion to the pressure bar front end, the front segment being at least partially disposed within the clamp body channel and having an upper surface defining a laterally extending groove, the groove forming a lip at the pressure bar front end, and a rear segment extending from the slot of the clamp body middle portion to the pressure bar rear end, the rear segment defining a vertically extending bore and an opening, extending from a side of the rear segment and intersecting the bore, the opening having a threaded surface;

a floating nut extending from a front end to a rear end through the slot of the clamp body middle portion, the floating nut being disposed below the pressure bar and including a front portion extending from the slot of the clamp body middle portion to the floating nut front end, the front portion being at least partially disposed within the clamp body channel, the front portion defining a vertically extending bore having a threaded surface, and a rear portion extending from the slot of the clamp body middle portion to the floating nut rear end; a bolt member including a bolt head disposed below the lower portion of the clamp body base segment, and a shaft extending upwardly from the bolt head through the opening of the lower portion of the clamp body base segment to a distal end contacting the pressure bar front segment, at least a portion of the shaft having a threaded surface threadably engaged with the bore of the floating nut front segment; and a ground engagement bolt including a bolt head, and a threaded shaft extending from the bolt head, the threaded shaft being received within the threaded opening of the pressure bar rear segment and being threadably displaceable therein to clamp a ground wire positioned within the bore of the pressure bar segment, wherein the extension segments of the clamp body legs are adapted for engaging the exterior surface of the drip cap and the bolt member is adapted for threadably driving the lip of the pressure bar front segment into the meter box overlap joint whereby the lip of the pressure bar front segment mechanically engages the abutting surfaces of the edge portion of the meter box drip cap and the upper end portion of the meter box panel to electrically connect the ground clamp to the meter box.

2. The meter box ground clamp of claim 1 wherein the base segment lower portion and the base segment middle portion form an angle substantially equal to 120°.

3. The meter box ground clamp of claim 1 wherein the threaded shaft of the ground engagement bolt includes a distal end having a circumferential, axially extending knife-like ridge adapted for digging into the ground wire when the ground engagement bolt is torqued.

4. The meter box ground clamp of claim 1 wherein the slot of the clamp body middle portion includes a main portion and a lower end portion, the pressure bar and floating nut each also include oppositely disposed first and second sides defining oppositely disposed notches separated by a web of material, the pressure bar notches dividing the pressure bar into the front and rear segments, the floating nut notches dividing the floating nut into the front and rear portions, the pressure bar web of material and the floating nut web of material each being disposed within the slot of the clamp body middle portion, the main portion of the slot-of the clamp body middle portion having a width ($W_m$), the lower end portion of the slot of the clamp body middle portion having a width ($W_L$), the pressure bar having a width ($W_{PB}$), the pressure bar web of material having a width ($W_{PBW}$), the floating nut having a width ($W_{FN}$), and the floating nut web of material having a width ($W_{FNW}$), wherein $W_m>W_L$, $W_{PB}>W_m>W_{PBW}>W_L$, and $W_{FN}>W_m>W_L>W_{FNW}$.

5. The meter box ground clamp of claim 1 wherein each of the leg segments has a lower portion extending obliquely into the clamp body channel below the lower portion of the base segment.

6. The meter box ground clamp of claim 5 wherein each of the leg segments also has a middle portion, the leg segment lower portion and the leg segment middle portion forming an angle substantially equal to 152°.

7. The meter box ground clamp of claim 1 wherein the pressure bar also includes oppositely disposed first and second sides defining oppositely disposed notches, the notches dividing the pressure bar into the front and rear segments, the notches being separated by a web of material, the web of material being disposed within the slot of the clamp body middle portion.

8. The meter box ground clamp of claim 7 wherein the first and second sides of the pressure bar define a pressure bar width ($W_{PB}$), the web of material separating the notches of the pressure bar has a width ($W_{PBW}$), and the slot of the clamp body middle portion has a width ($W_m$), wherein $W_{PB}>W_m>W_{PBW}$.

9. The meter box ground clamp of claim 7 wherein the pressure bar front and rear segments each have a height, the height of the pressure bar rear segment being greater than the height of the pressure bar front segment.

10. The meter box ground clamp of claim 7 wherein the groove of the pressure bar front segment has a rear edge forming an angle substantially equal to 15° with the pressure bar front end and the lip of the pressure bar front segment has a tip having a thickness substantially equal to 0.010 inches.

11. The meter box ground clamp of claim 10 wherein the pressure bar front end has upper and lower portions, the lower portion of the front end extending rearwardly from the upper portion of the front end, forming an angle substantially equal to 15°.

12. The meter box ground clamp of claim 1 wherein each leg segment has upper, middle and lower portions, the extension segment extending laterally from a front edge of the middle portion.

13. The meter box ground clamp of claim 12 wherein the extension segment includes a front portion having a downwardly extending tooth, the tooth being adapted for penetrating the corrosion inhibiting coating on the meter box drip cap.

14. The meter box ground clamp of claim 13 wherein the extension segment has a lower edge and the tooth has front and rear edges joined at an acute angle, forming a sharp point.

15. The meter box ground clamp of claim 1 wherein the floating nut also includes oppositely disposed first and second sides defining oppositely disposed notches, the notches dividing the floating nut into the front and rear portions, the notches being separated by a web of material, the web of material being disposed within the slot of the clamp body middle portion.

16. The meter box ground clamp of claim 15 wherein the first and second sides of the floating nut define a floating nut width ($W_{FN}$), the web of material separating the notches of the floating nut has a width ($W_{FNW}$), and the slot of the clamp body middle portion has a width ($W_m$), wherein $W_{FN}>W_m>W_{FNW}$.

17. The meter box ground clamp of claim 15 wherein the floating nut further includes oppositely disposed upper and lower surfaces, each of notches extending from a position proximate to the floating nut rear end at the upper surface to a position disposed intermediate the floating nut front and rear ends at the lower surface.

18. The meter box ground clamp of claim 17 wherein the notches form an angle substantially equal to 27° with the floating nut rear end.

19. The meter box ground clamp of claim 7 wherein a lower surface of the pressure bar front segment defines a hemispherically-shaped socket for receiving the distal end of the bolt member shaft.

20. The meter box ground clamp of claim 19 wherein the distal end of the bolt member has the shape of a cone having a rounded tip.

21. A meter box ground clamp for clamping a ground wire to a metallic meter box, the meter box including a drip cap, a front panel, a rear panel, and left and right side panels, the drip cap having an edge portion forming an overlap joint with an upper end portion of at least one of the panels, the drip cap edge portion and the panel upper end portion having substantially abutting bare-metal surfaces, the meter box having an exterior surface covered by a corrosion inhibiting coating, the meter box ground clamp comprising:

a U-shaped clamp body defining a vertical axis and including a base segment having a middle portion defining a longitudinally extending slot, a lower portion extending obliquely from the middle portion into the channel, the lower portion defining a substantially circular opening, and an upper portion extending longitudinally from the middle portion;

first and second leg segments forming a vertically extending, open channel with the base segment, each of the leg segments having upper, middle and lower portions, and an extension segment extending laterally from a front edge of the middle portion, the lower portion of each leg segment extending obliquely into the clamp body channel below the lower portion of the base segment, the extension segment including a front portion having a downwardly extending tooth adapted for penetrating the corrosion inhibiting coating on the meter box drip cap;

a pressure bar including oppositely disposed front and rear ends, oppositely disposed upper and lower surfaces, oppositely disposed first and second sides defining oppositely disposed notches separated by a web of material disposed within the slot of the clamp body middle portion, the notches dividing the pressure bar into a front segment extending to the pressure bar front end, the front segment being at least partially disposed within the clamp body channel, the upper surface defining a laterally extending groove forming a lip at the pressure bar front end, the lower surface defining a socket, and a rear segment extending to the pressure bar rear end, the rear segment defining a vertically extending bore and an opening, extending from a side of the rear segment and intersecting the bore, the opening having a threaded surface;

a floating nut disposed below the pressure bar, the floating nut including oppositely disposed front and rear ends, oppositely disposed upper and lower surfaces, oppositely disposed first and second sides defining oppositely disposed notches separated by a web of material disposed within the slot of the clamp body middle portion, the notches dividing the floating nut into a front portion extending to the floating nut front end, the front portion being at least partially disposed within the clamp body channel, the front portion defining a vertically extending bore having a threaded surface, and a rear portion extending to the floating nut rear end;

a bolt member including a bolt head disposed below the lower portion of the clamp body base segment, and a shaft extending upwardly from the bolt head through the opening of the lower portion of the clamp body base segment to a distal end, at least a portion of the shaft having a threaded surface threadably engaged with the bore of the floating nut front segment, the distal end of the shaft being receivable within the socket of the pressure bar front segment; and a ground engagement bolt including a bolt head, and a threaded shaft extending from the bolt head, the threaded shaft being received within the threaded opening of the pressure bar rear segment and being threadably displaceable therein to clamp a ground wire positioned within the bore of the pressure bar segment;

wherein the extension segments of the clamp body legs are adapted for engaging the exterior surface of the drip cap and the bolt member is adapted for threadably driving the lip of the pressure bar front segment into the meter box overlap joint whereby the lip of the pressure bar front segment mechanically engages the abutting surfaces of the edge portion of the meter box drip cap and the upper end portion of the meter box panel to electrically connect the ground clamp to the meter box.

22. The meter box ground clamp of claim 21 wherein the slot of the clamp body middle portion includes a main portion having a width ($W_m$) and a lower end portion having a width ($W_L$), the pressure bar having a width ($W_{PB}$), the pressure bar web of material having a width ($W_{PBW}$), the floating nut having a width ($W_{FN}$), and the floating nut web of material having a width ($W_{FNW}$), wherein $W_m > W_L$, $W_{PB} > W_m > W_{PBW} > W_L$, and $W_{FN} > W_m > W_L > W_{FNW}$.

23. The meter box ground clamp of claim 21 further comprising a boot including a rectangular upper wall having a lower surface and an outer perimeter;

an outer skirt extending downwardly from the outer perimeter of the upper wall, the upper wall and outer skirt forming an outer cavity having oppositely disposed first and second end portions;

an inner skirt extending downwardly from the lower surface of the upper wall within the first end portion of the outer cavity; and a gel-disposed within the second end portion of the outer cavity;

wherein the inner skirt is inserted into the channel formed by the clamp body base segment and leg segments and the front portion of the extension segments of the clamp body leg segments are received in the second end portion of the outer cavity, whereby the gel provides a weather-tight seal preventing the meter box enclosure from corroding in the area where the clamp body tooth has penetrated the corrosion inhibiting coating.

* * * * *